US005120227A

United States Patent [19]

Born

[11] Patent Number: 5,120,227

[45] Date of Patent: Jun. 9, 1992

[54] SKI TRAINING DEVICE

[76] Inventor: Christopher M. Born, 3704 Plumb, Houston, Tex. 77005

[21] Appl. No.: 638,065

[22] Filed: Jan. 7, 1991

[51] Int. Cl.[5] ..... A63B 69/18

[52] U.S. Cl. ..... 434/253; 135/66; 135/72; 482/71

[58] Field of Search ..... 272/70, 97; 434/253; 135/66, 72, 76

[56] References Cited

U.S. PATENT DOCUMENTS

| | | | |
|---|---|---|---|
| 2,545,009 | 3/1951 | Spiteri | 35/29 |
| 2,984,497 | 5/1961 | Hagen | 280/11.35 |
| 3,014,284 | 12/1961 | Hall | 35/29 |
| 3,529,819 | 9/1970 | Blank | 272/70 |
| 3,738,674 | 6/1973 | Pauls | 435/66 X |
| 4,424,040 | 1/1984 | Buchheister et al. | 434/253 |
| 4,505,681 | 3/1985 | Jones | 434/253 |
| 4,643,444 | 2/1987 | Parkinson | 434/253 X |
| 4,846,690 | 7/1989 | Williams | 434/253 |

FOREIGN PATENT DOCUMENTS

| | | | |
|---|---|---|---|
| 2730892 | 1/1979 | Fed. Rep. of Germany | 272/97 |
| 0646335 | 11/1984 | Switzerland | 272/97 |

*Primary Examiner*—Richard J. Apley
*Assistant Examiner*—L. Thomas
*Attorney, Agent, or Firm*—Ben D. Tobor

[57] ABSTRACT

A ski training device includes: a ski having an upstanding elongate member attached thereto; and two handle means associated with the upstanding elongate member, one handle means for an inexperienced skier, and the other handle means for an experienced skier.

9 Claims, 2 Drawing Sheets

SKI TRAINING DEVICE

FIELD OF THE INVENTION

The invention relates to a ski training device for teaching an inexperienced skier, such as a child, how to ski.

DESCRIPTION OF THE PRIOR ART

Many methods and devices have been proposed for teaching inexperienced skiers, such as children, how to ski. It is quite common to physically restrain the motion of a beginner skier, or student, by use of a strap or rope wrapped around the student's waist and extending rearwardly to a position where the strap can be held by a more experienced skier, such as a ski instructor. Another method, primarily for use with small children, includes the use of a harness or halter around the student's upper torso or chest and shoulders with a strap or rope extending from the harness or halter rearwardly to a position where it can be held by the instructor. Such use of harnesses, halters, straps or ropes is believed to have serious disadvantages. Although these devices are believed to be effective to restrain the forward velocity of the student, they are ineffective to assist the student in his or her efforts to attempt the weight shift and hip rotation movements necessary to use the parallel technique of skiing. It is further believed that such halters and harnesses actually inhibit a student's efforts to use these parallel skiing techniques, in that one of the major disadvantages of these restraint devices is that the restraint force exerted by the instructor on the student's waist or upper torso region tends to pull the student, who is usually already unstable, further off balance.

Another type of ski training device includes a structure attached between the student and the ski instructor. This type of device includes a harness worn on the back of the ski instructor which has a long rigid shaft extending outwardly and rearwardly therefrom, and a handlebar is attached to the end of the long rigid shaft. The student then grasps the handle bar and skis behind the instructor. A device of this type is illustrated in U.S. Pat. No. 3,014,284, issued to S. G. Hall on Dec. 26, 1961. It is believed that the rigid shaft of this device may constitute a hazard in the event of one of the skiers falling. This device, since it is worn on the back of the instructor who must then face away from the student, does not allow the instructor to readily observe the student skier, nor is it believed that this device provides stability to the student skier, in that it is believed that the handlebar is subject to substantial movement because of its attachment to the ski instructor.

Accordingly, prior to the development of the present invention, there has been no ski training device which: provides stability to the student skier; does not include motion restraining harnesses, halters, straps, or ropes: permits the instructor to ski alongside the student skier; and permits the instructor to readily observe, and give oral instructions, to the student skier. Therefore, the art has sought a ski training device which: does not include motion restraining harnesses, halters, straps, or ropes; provides stability to the student skier, while permitting the student skier to maintain his or her balance; permits the instructor to ski alongside the student skier and to readily observe and give oral instructions to the student skier; and is simple and economical to manufacture and use.

SUMMARY OF THE INVENTION

In accordance with the present invention, the foregoing advantages have been achieved through the present ski training device. The present invention includes: a ski; a first elongate member attached to the ski, the elongate member being disposed substantially perpendicular to the ski; and first and second handle means associated with the elongate member, the first handle means being adapted for use by an inexperienced skier learning how to ski, the second handle means being adapted for use by an experienced skier, whereby the two skiers may grasp their respective handle means, and the ski attached to the elongate member provides stability for the inexperienced skier. A feature of the present invention is that the height of the first and second handle means above the ski may be variable. A further feature of the present invention is that the first and second handle means may each include an elongate member disposed substantially perpendicular to the first elongate member.

Another feature of the present invention is that the elongate member of the first handle means and the elongate member of the second handle means may extend outwardly from the first elongate member and may be disposed on opposite sides of the first elongate member. A further feature of the present invention is that the elongate members of the first and second handle means may lie in planes which are substantially parallel with one another. A further feature of the invention is that the elongate member of the first handle means and the elongate member of the second handle means may extend outwardly from the first elongate member and may be disposed on the same side of the first elongate member. An additional feature of the present invention is that the elongate member of the first handle means may be attached to the first elongate member, and the elongate member of the second handle means may be connected to the elongate member of the first handle means by a connector member, the connector member being disposed substantially perpendicular to the first and second handle means.

The ski training device of the present invention, when compared with previously proposed prior art ski training devices has the advantages of: not including motion restraining harnesses, halters, straps, or ropes; providing stability to the inexperienced skier; permitting the instructor, or experienced skier, to ski alongside the inexperienced, or student, skier and to readily observe and give oral instructions to the student skier; being easy and economical to manufacture and use.

Figure 1:
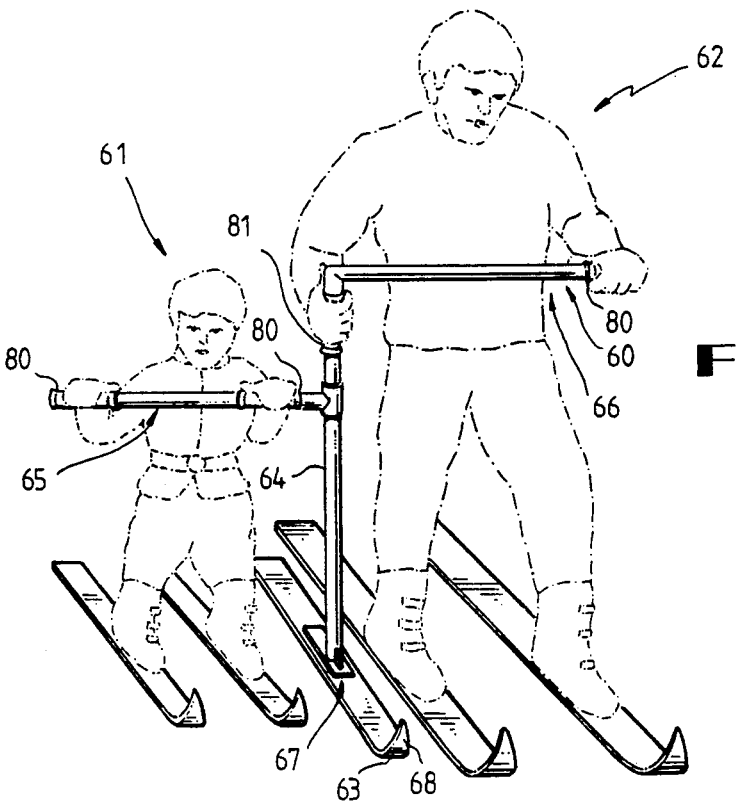
FIG. 1 is a perspective view of the ski training device in accordance with the present invention being used by a student skier and a ski instructor.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

With reference to FIGS. 1–4, a ski training device 60 in accordance with the present invention, is shown being used by an inexperienced, or student skier 61, or small child, and by an experienced skier, or instructor, 62. Ski training device 60 generally comprises a ski 63; a first elongate member 64 attached to the ski 63; and first and second handle means 65, 66 associated with elongate member 64. Elongate member 64 is preferably disposed substantially perpendicular to the ski and may be preferably releasably secured to ski 63 by any suitable connection means 67 which permits elongate member 64 to be disassembled from ski 63. For example, elongate member 64 could be screwed into a bracket on ski 63, or bolted to ski 63. Ski 63 may be formed of any suitable material from which conventional skis are manufactured, and ski 63 includes an inclined tip portion 68.

Still with reference to FIGS. 1–4, first handle means 65 is adapted for use by student skier 61, and the second handle means 66 is adapted for use by the ski instructor 62, whereby the two skiers 61, 62 may grasp their respective handle means 65, 66, and ski alongside one another while the ski 63, attached to the elongate member 64, provides stability for the inexperienced skier 61, without restraining the motion of skier 61. Preferably, first and second handle means 65, 66 each include an elongate member 70, 71 disposed substantially perpendicular to the first elongate member 64. Preferably, first elongate member 64, and elongate member 70, 71 are tubular members made of any suitable material, such as aluminum, steel, or any suitable plastic having the requisite strength characteristics associated with having skiers 61, 62 placing force upon elongate members 70, 71 and first elongate member 64. Although elongate members 70, 71 and first elongate member 64 are illustrated having a tubular configuration, it should be readily apparent to one of ordinary skill in the art, that they could have any other cross-sectional configuration, such as hexagonal, square, or rectangular, etc.

Figure 2:
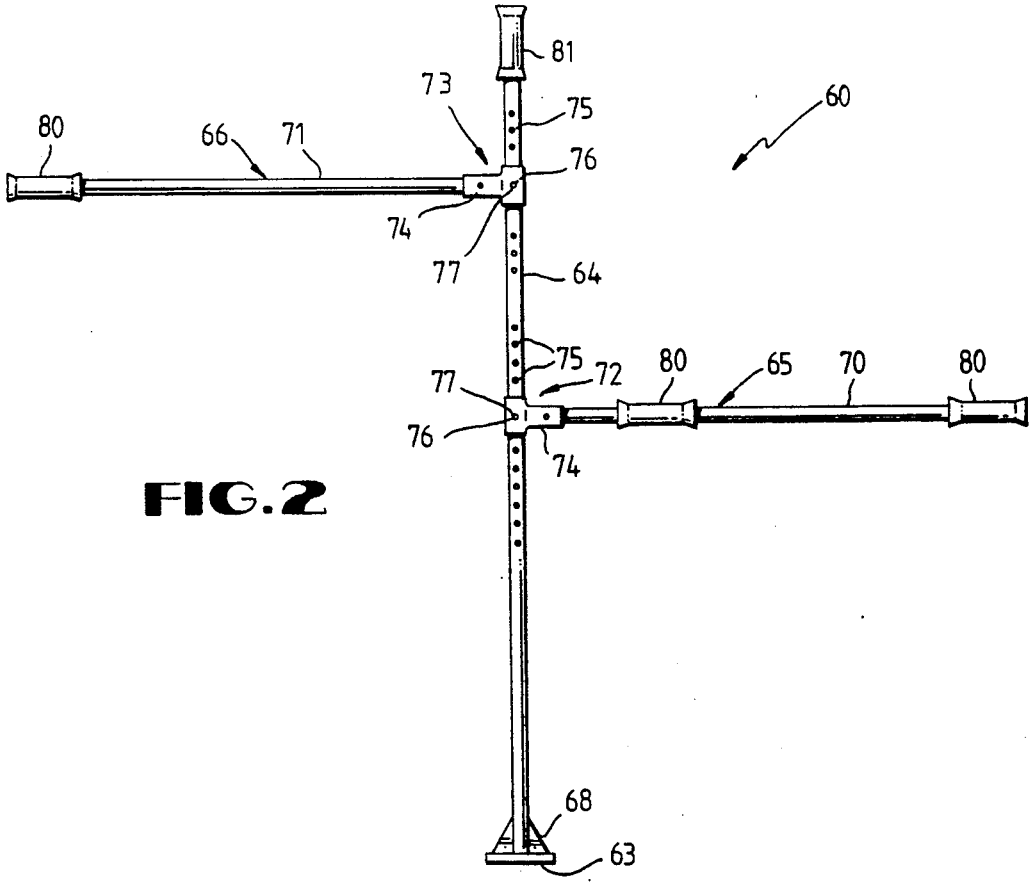
FIG. 2 is a rear view of one embodiment of a ski training device in accordance with the present invention.

As seen in FIG. 2, the inner ends 72, 73 of elongate members 70, 71 are each provided with a suitable T shaped fitting 74 which receives the ends 72, 73 of elongate members 70 and 71. Fittings 74 are movable upwardly or downwardly along first elongate member 64, whereby the height of the first and second handle means 65. 66 above ski 63 may be varied. As seen in FIG. 2, first elongate member 64 has a plurality of openings 75, which openings can mate with an opening 76 in each fitting 74. A bolt, or any other suitable fastener, 77 may be passed through mating openings 75, 76 to fixedly secure fittings 74 to first elongate member 64 at the desired height above ski 63. If desired, first and second handle means 65, 66 can be provided with any type of suitable hand grips 80, which can be made of any suitable plastic material, which may, or may not be, cushioned. A hand grip 81 may be provided on the first elongate member 64 at the upper end of first elongate member 64, which extends above the second handle means 66, as illustrated in FIG. 2. Alternatively, second handle means 66 may be fixedly secured to the upper end of first elongate member 64, as seen in FIG. 1. and a hand grip 81 may be disposed upon first elongate member 64, below second handle means 66, as illustrated in FIG. 1. As illustrated in FIGS. 1 and 2, the elongate member 70 of the first handle means 65, and the elongate member 71 of the second handle means 66 extend outwardly from the first elongate member 64 and are disposed on opposite sides of the first elongate member 64. Preferably, the elongate member 70, 71 of the first and second handle means 65, 66 lie in planes which are substantially parallel with one another, as illustrated in FIGS. 1 and 2.

When using the ski training device 60 of the present invention, both skiers 61, 62 hold their respective handle means 65, 66 and ski alongside each other down a hill or slope. The experienced skier 62 is able to readily control the movement of ski 63 and first elongate member 64, in the desired manner, by applying force to first elongate member 64 and second handle means 66, whereby the inexperienced, or student, skier 61 can achieve stability and balance by holding on to first handle means 65, in the manner illustrated in FIG. 1, without the necessity of confining and motion restraining harnesses, halters, etc.

Figure 5:
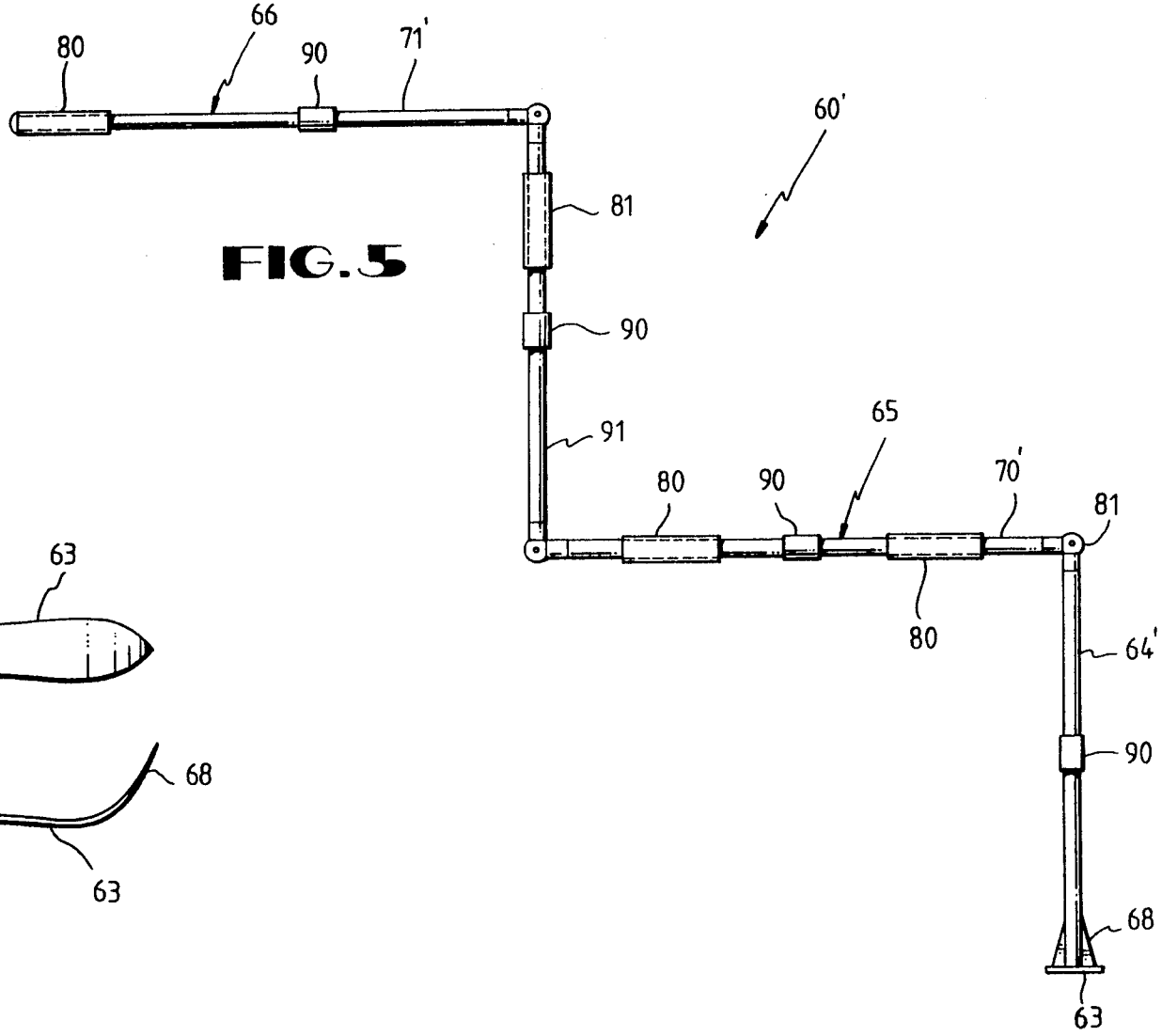
FIG. 5 is a front view of another embodiment of a ski training device in accordance with the present invention.
Figure 4:
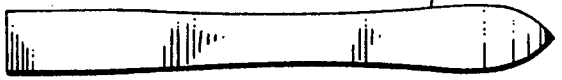
FIG. 4 is a top view of the ski of FIG. 3.
Figure 3:
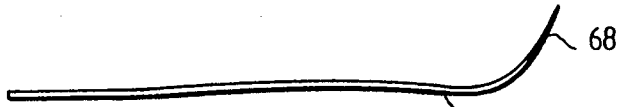
FIG. 3 is a side view of a ski component of the ski training device in accordance with the present invention.

With reference to FIG. 5, another embodiment of a ski training device 60' in accordance with the present invention is illustrated. For ease of description, primed reference numerals will be utilized for components having similar construction to those of ski training device 60 previously described, and identical reference numerals will be used for components having the same construction as those previously described in connection with ski training device 60. Ski training device 60' is seen to be generally comprise: a ski 63 with incline tip portion 68; a first elongate member 64' attached to the ski 63; and first and second handle means 65, 66 are associated with elongate member 64', the first handle means 65 being adapted for use by an inexperienced skier and the second handle means 66 being adapted for use by an experienced skier. The first and second handle means 65, 66 each include an elongate member 70', 71' disposed substantially perpendicular to the first elongate member 64' The width of elongate member 70', 71', as well as the height of first elongate member 64' may be varied as by having first elongate member 64' and elongate members 70', 71' being of tubular, telescoping construction the two telescoping portions of each elongate member 64', 70', 71', being fixedly secured as by tightening a conventional friction nut 90 where the two sections of each elongate member 64', 70', 71' are telescopically connected. Preferably, elongate members 64', 70', 71' are tubular members; however, as will be apparent to one of ordinary skill in the art, elongate members 64', 70', 71' could have any suitable cross-sectional configuration, as previously described in connection with ski training device 60 of FIGS. 1–4.

Still with reference to FIG. 5, the elongate member 70' of the first handle means 65 is attached to the first elongate member 64' as by any suitable connection 81, and the elongate member 71' of the second handle means 66 is connected to the elongate member 70' of the first handle means 65 by a connector member 91, which preferably has the same construction as elongate member 70', 71'. including being variable in length as by a telescoping construction and friction nut 90. Preferably, connector member 91 is disposed substantially perpendicular to the first and second handle means 65, 66.

Preferably, the elongate member 70' of the first handle means 65 and the elongate member 71' of the second handle means 66 extend outwardly from the first elongate member 64' and are disposed on the same side of the first elongate member 64. Hand grips 80, 81 as previously described may be utilized in connection with first and second handle means, 65, 66.

When using the ski training device 60' of FIG. 5, the experienced skier would grasp second handle means 66', with the inexperienced skier being disposed between the experienced skier and ski 63, the inexperienced skier grasping first handle means 65. Ski 63 is then disposed as an "outrigger" ski, which along with the experienced skier controlling second handle means 66, provides the inexperienced skier with stability and balance when he or she grasps first handle means 65.

It is to be understood that the invention is not limited to the exact details of construction, operation, exact materials, or embodiments shown and described, as obvious modifications and equivalents will be apparent to one skilled in the art; for example, the first and second handle means could be curved tubular members having a semi-circular configuration, the bodies of the skier being disposed within the semi circular, concave portion of the elongate members. Accordingly, the invention is therefore to be limited only by the scope of the appended claims.

I claim:

1. A ski training device comprising: a ski;

a first elongate member attached to the ski, the elongate member being disposed substantially perpendicular to the ski; and first and second handle means associated with the elongate member, the first handle means being adapted for use by an inexperienced skier learning how to ski, the second handle means being adapted for use by an experienced skier, whereby the two skiers may grasp their respective handle means; and the ski attached to the elongate member provides stability for the inexperienced skier.

2. The ski training device of claim 1, wherein the height of the first and second handle means above the ski is variable.

3. The ski training device of claim 1, wherein the first and second handle means each include an elongate member disposed substantially perpendicular to the first elongate member.

4. The ski training device of claim 3, wherein the elongate members of the first and second handle means and the first elongate member are tubular members.

5. The ski training device of claim 3, wherein the elongate member of the first handle means and the elongate member of the second handle means extend outwardly from the first elongate member and are disposed on opposite sides of the first elongate member.

6. The ski training device of claim 5, wherein the elongate members of the first and second handle means lie in planes which are substantially parallel with one another.

7. The ski training device of claim 3, wherein the elongate member of the first handle means and the elongate member of the second handle means extend outwardly from the first elongate member and are disposed on the same side of the first elongate member.

8. The ski training device of claim 7, wherein the elongate member of the first handle means is attached to the first elongate member, and the elongate member of the second handle means is connected to the elongate member of the first handle means by a connector member, the connector member being disposed substantially perpendicular to the first and second handle means.

9. The ski training device of claim 8, wherein the length of the connector member is variable.

* * * * *